United States Patent [19]

Blatt

[11] Patent Number: 4,733,423

[45] Date of Patent: Mar. 29, 1988

[54] POP TOP CAN BRUSH

[76] Inventor: Gregory Blatt, P.O. Box 18, East Port, Me. 04631

[21] Appl. No.: 903,960

[22] Filed: Sep. 5, 1986

[51] Int. Cl.[4] ..... A46B 9/02

[52] U.S. Cl. ..... 15/160; 15/70; 15/104.04; D4/130

[58] Field of Search ..... 15/65, 67, 70, 56, 21 A, 15/180, 164, 104.01 R, 104.01 B, 104.03, 104.04, 104.02; D4/130, 137, 127; D32/40, 46

[56] References Cited

U.S. PATENT DOCUMENTS

| | | | |
|---|---|---|---|
| 490,682 | 1/1893 | Roemer | 15/191 R |
| 1,362,822 | 12/1920 | Rude | 15/70 |
| 2,672,633 | 3/1954 | Allen | 15/21 A |
| 2,672,637 | 3/1954 | Allen | 15/21 A |
| 4,301,567 | 11/1981 | Tucker | 15/160 |

FOREIGN PATENT DOCUMENTS

| | | | |
|---|---|---|---|
| 453012 | 11/1927 | Fed. Rep. of Germany | 15/65 |

*Primary Examiner*—Peter Feldman
*Attorney, Agent, or Firm*—Clifford G. Frayne

[57] ABSTRACT

A pop top can brush for the cleaning of aluminum and metal pop top cans having a substantially planer top surface, a sidewall substantially perpendicular to the planer top surface, the planar top surface of sidewall having a common circumferential edge, a plurality of cleaning means depending downwardly from the substantially planer top surface and a second plurality of cleaning means depending inwardly from the perpendicular sidewall, the cleaning means positioned to coincide with at least a portion of the circular top of an aluminium or metal pop top can.

1 Claim, 5 Drawing Figures

POP TOP CAN BRUSH

FIELD OF THE INVENTION

The present invention is directed to an improvement in brushes and, in particular, to a novel brush for cleaning aluminum or metal pop top cans.

BACKGROUND OF THE INVENTION

Aluminum and steel cans of the pop top variety are well known in the art and are pervasive in our present society. All types of beverages are packaged in such cans and sold to the general public. In many instances, because of the design of the cans, dirt and other foreign material accumulate around the rim of the cans. Since aluminum cans are designed for convenience in the marketplace and convenience to the consumer in consumption, the contents of such cans are many times consumed by the user by drinking directly from the cans. In such instances, the foreign material which may accumulate in the annular ridges of the can presents a negative image to the consumer. The dirt or other foreign material which accumulates in the cans may be the result of the storage of the cans for some time on shelves or may have accumulated during the transportation of the cans. This dirt or foreign material may be removed by washing the cans or attempts can be made to remove the dirt and foreign material by wiping it with a cloth. However, in many instances, the liquid contents of the aluminum or metal cans sometimes accumulates in these ridges and dries to a sticky, adhesive-type mass which is not easily removed.

Applicant's invention is related to a brush to clean the ridges and indentations around the top of the aluminum and metal cans and Applicant's brush is designed to be hand-held or mounted in a thermos cooler which is utilized by the general public for transporting and cooling aluminum and metal cans.

OBJECTS OF THE INVENTION

An object of the present invention is to provide a novel brush for the cleaning of aluminum and metal beverage cans.

Another object of the present invention is to provide a novel brush which will clean the annular indentations of an aluminum or metal can located both on the top of the metal can and on the sides proximate to the top of the aluminum and metal cans.

Another object of the present invention is to provide for a novel brush for the cleaning of aluminum and metal cans which may either be hand-held or mounted.

SUMMARY OF THE INVENTION

These and other objects of the present invention are derived from an aluminum pop top can brush substantially C-shaped in design and L-shaped in cross sectional area having a planer arcuate upper member of less than semi-circular dimensions, and an arcuate semi-circular sidewall depending from the planer arcuate upper member thereby defining a concave-shaped inner chamber, there being depending downwardly from the planer arcuate upper member, a plurality of bristle brushes or equivalence and there being depending outwardly from said inner surface of the arcuate sidewall, a plurality of bristle brushes or equivalents. The size and shape of the arcuate brush and the number of bristles being positioned such that the bristles depending from said upper planer arcuate member are positioned to clean the annular indent and the top planer surface of an aluminum or steel pop top can and the depending bristle brushes from the arcuate sidewall are designed and positioned to clean the annular indent around the outer circumference of the aluminum or steel pop top can.

BRIEF DESCRIPTION OF THE DRAWINGS

A better understanding of the present invention as well as other objects and advantages thereof, will become apparent upon consideration of the detailed disclosure thereof, especially when taken with the accompanying drawings wherein.

DETAILED DESCRIPTION OF THE DRAWINGS

Figure 1:
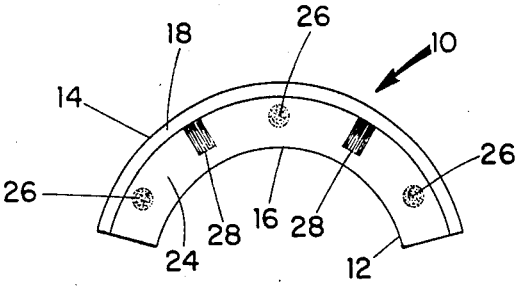
FIG. 1 is a bottom planer view of the pop top can brush.
Figure 2:
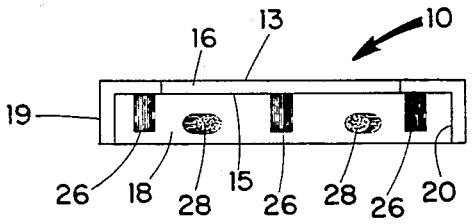
FIG. 2 is a side elevational view of the pop top can brush in the position of use.

Considering FIGS. 1 and 2, there is shown a planer bottom view and a side elevational view of a pop top can brush 10 being generally C-shaped and having a planer arcuate upper member 12 having an upper planer arcuate surface 13 and a lower planer arcuate surface 15. The radial curvature A of planer arcuate upper member 12 is designed to conform to the circumference of a typical aluminum or metal pop top can. In practice, the arc distance of planer arcuate upper member 12 could be as much as one-half circumference of an aluminum or metal pop top can, but it has been found in practice for ease of use with respect to the pop top can brush that it be less than the semi-circular distance. Upper planer arcuate member 12 has an outer circumferential edge 14 and an inner surface circumferential edge 16. Depending downwardly from outer circumferential edge 14, is an arcuate perpendicular sidewall 18 having an outer surface 19 and an inner surface 20 as can best be seen in FIG. 2. Planer arcuate member 12 and arcuate perpendicular sidewall 18 present an L-shaped cross section of brush 10.

The inner surface 20 of arcuate perpendicular sidewall 18 and lower planer arcuate surface 15 of upper planer member 12 define a partial concave chamber 24 which is complimentary to the top of an aluminum or metal pop top can as disclosed hereafter.

There is depending downwardly from lower planer arcuate surface 15 of planer arcuate member 12 into partial concave chamber 24, a plurality of first cleaning means. As shown in FIG. 2, these cleaning means comprise bristle brushes 26 secured to arcuate member 12 and depending substantially perpendicular downwardly therefrom. Depending on variations and design of aluminum cans, these depending bristle brushes 26 may be offset from the perpendicular.

Depending inwardly into partial concave chamber 24 from inner arcuate surface 20 of depending sidewall 18, are a plurality of second cleaning means. As shown in FIG. 2, these cleaning means comprise a plurality of bristle brushes 28 secured to inner surface 20 of depending arcuate sidewall 18 and extending perpendicularly outwardly therefrom into partial concave chamber 24. Again, depending upon variations in the design of aluminum or metal pop top cans, these sidewall brushes 28 may be offset from the perpendicular of depending arcuate sidewall 18.

The embodiment shown herein contains depending bristle brushes embedded or secured in the depending arcuate sidewall 18 and the arcuate planer member 12. Other cleaning means such as bristle-type material or sponge-like material might be secured to these inner surfaces to accomplish the same tasks without deviating from the scope and spirit of the invention; however, Applicant has determined that due to the variety of annular ridges and indents found on aluminum and metal pop top cans, the use of semi-rigid bristles performs best.

Figure 3:
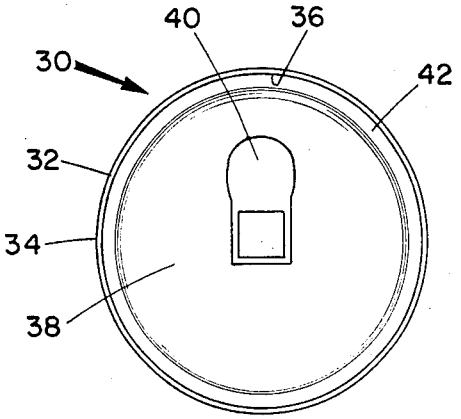
FIG. 3 is a top planer view of a typical aluminum or metal can.

Referring to FIG. 3, there is shown a top planer view of a typical pop top can generally designated as 30. Can 30 has an upper lip 32 defined by the outer circumference 34 of can 30 and an inner circumference 36. Can 30 contains a substantially planer circular top 38 which incorporates the pop top clip 40. Between upper planer circular surface 38 of can 30 and lip 32, there is defined an annular depression 42.

Figure 4:
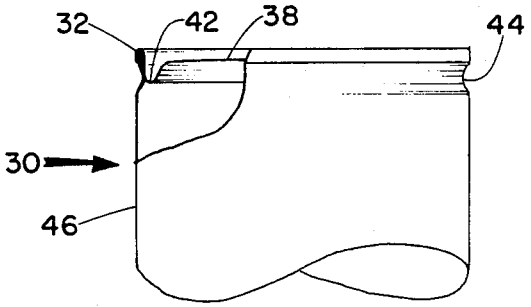
FIG. 4 is a side elevational view of the top of a typical pop top can with a break-away section showing the area to be cleaned.

Referring to FIG. 4, there is shown a partial side view with break-away section of can 30. FIG. 4, through the side elevational view, shows the relationship between lip 32, annular depression 42 and planer circular surface 38 of can 30. In addition, it can be seen that can 30 has an annular indent 44 in circumferential sidewall 46, proximate to annular lip 32 and located slightly below annular lip 32.

Pop top can brush 10 is designed to remove dirt and other foreign material from the top of can 30 and, in particular from annular indent 42, a portion of planer upper surface 38, annular lip 32, and annular indent 44 in sidewall 46. Depending bristle brushes 26 from planer arcuate member 12 are designed to engage annular lip 32, annular depression 42 and a portion of planer circular surface 38 of can 30. Inwardly depending bristle brushes 28 of depending sidewall 18 are designed to engage sidewall 46 of can 30 and annular indent 44 of sidewall 46.

Figure 5:
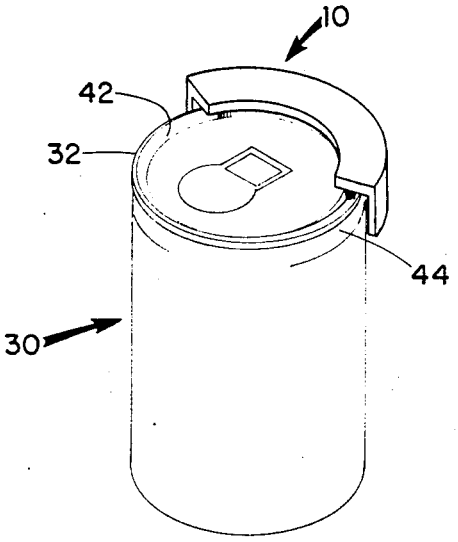
FIG. 5 is a perspective view of an aluminum pop top can with the brush in position.

In practice, as best can be seen in FIG. 5, which is a perspective view of brush 10 in cooperation with aluminum or metal can 30, brush 10 is held in the palm of a hand containing outer arcuate surface 19 and upper planer arcuate surface 13. Brush 10 would be held such that the circumference of brush 10 would conform to the curvature of the operator's palm. The operator would hold the aluminum can in the other hand and rotate either brush 10 or aluminum or metal can 30 such that bristle brushes 26 and 28 would engage the aforementioned surfaces of the aluminum or metal can 30 and remove dirt and other foreign matter.

The design of brush 10 permits easy cleaning of the brush and by limiting its arc distance or curvature, it permits the operator to clean aluminum or metal pop top cans of slightly different dimensions since the tops of aluminum cans and the tops of metal cans vary somewhat in their circumference and the design and location of annular indentations which permit the accumulation of dirt or other foreign materials. Additionally, brush 10 of the general design as envisioned by Applicant, could be expanded in size to accommodate metal and aluminum cans of varying circumference not necessarily utilized in the packaging of beverages. However, Applicant envisions the primary use of brush 10 with respect to containers of a pop top nature wherein the contents are consumed directly from the container.

The Applicant has determined that the preferred embodiment of the pop top can brush is shown and described herein. However, a pop top can brush that is completely circular having a radial curvature substantially identical to the radial curvature of the top of a pop top can can perform the desired function, but it would present a larger apparatus which might have practical drawbacks in the marketplace. Additionally, while the preferred embodiment, as shown herein, is described with well-defined edges, it will be recognized by one skilled in the art, that these edges may be rounded or curved without deviating from the spirit and scope of the present invention.

While the preferred embodiment of brush 10 is a hand-held brush for ease and convenience of use, a second embodiment would be identical to that previously described with the exception that fastening means could be incorporated in brush 10 to permit it to be secured to a thermos cooler.

While the present invention has been described in connection with the exemplary embodiment thereof, it will be understood that many modifications will be apparent to those of ordinary skill in the art; and that this application is intended to cover any adaptation and variations thereof. Therefore, it is manifestly intended that this invention be only limited by the claims and the equivalents thereof.

I claim:

1. A hand-held pop top can brush for the cleaning of aluminum and metal pop top cans having a planer circumferential top indentation and a circumferential side indentation comprising a C shaped planer circular top surface having a C shaped circumferential perpendicular sidewall depending therefrom, said circular planer top surface and said circumferentially perpendicular sidewall being slightly circumferentially larger than the circumference of said aluminum or metal pop top cans; said circular planer top surface having a first non-abrasive cleaning means secured thereto and depending downwardly therefrom; said circumferentially perpendicular sidewall having a plurality of second non-abrasive cleaning means secured thereto and extending inwardly therefrom, said plurality of first cleaning means and plurality of said second means positioned so as to coincide with said circumferential indentations on said aluminum or metal pop top cans.

* * * * *